US011578715B2

(12) United States Patent
Fujisaki et al.

(10) Patent No.: US 11,578,715 B2
(45) **Date of Patent: *Feb. 14, 2023**

(54) PUMP

(71) Applicant: Murata Manufacturing Co., Ltd., Kyoto (JP)

(72) Inventors: Masaaki Fujisaki, Kyoto (JP); Kenichiro Kawamura, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 27 days.

This patent is subject to a terminal disclaimer.

(21) Appl. No.: 17/146,527

(22) Filed: Jan. 12, 2021

(65) Prior Publication Data

US 2021/0131416 A1 May 6, 2021

Related U.S. Application Data

(63) Continuation of application No. 15/795,341, filed on Oct. 27, 2017, now Pat. No. 10,920,765, which is a (Continued)

(30) Foreign Application Priority Data

Apr. 27, 2015 (JP) ..... JP2015-090170

(51) Int. Cl.
*F04B 43/02* (2006.01)
*F04B 45/047* (2006.01)
(Continued)

(52) U.S. Cl.
CPC ..... *F04B 43/023* (2013.01); *F04B 43/046* (2013.01); *F04B 45/047* (2013.01); *F04B 53/1077* (2013.01)

(58) Field of Classification Search
CPC ..... F04B 43/023; F04B 43/04; F04B 43/043; F04B 43/46; F04B 43/095; F04B 45/047; F04B 19/006; F04B 53/1077
See application file for complete search history.

(56) References Cited

U.S. PATENT DOCUMENTS 3,804,107 A 4/1974 Kozlov et al.
8,684,707 B2 * 4/2014 Kanai ..... F04B 45/047 417/410.2
(Continued)

FOREIGN PATENT DOCUMENTS

CN 102057163 A 5/2011
CN 102979706 A 3/2013
(Continued)

OTHER PUBLICATIONS

International Search Report issued in PCT/JP2016/062970 dated Aug. 2, 2016.
Written Opinion issued in PCT/JP2016/062970 dated Aug. 2, 2016.

*Primary Examiner* — Kenneth J Hansen
(74) *Attorney, Agent, or Firm* — Pearne & Gordon LLP

(57) ABSTRACT

A pump is provided with a pump housing, a vibrating portion, a driving portion, and a displacement regulating portion. The pump housing internally has a pump chamber. The vibrating portion is supported against the pump housing in the pump chamber and divides the pump chamber into a first pump chamber and a second pump chamber. The driving portion drives the vibrating portion so as to bend and vibrate the vibrating portion in a predetermined direction. The displacement regulating portion is positioned to prevent displacement of the vibrating portion that results in plastic deformation.

24 Claims, 12 Drawing Sheets

Related U.S. Application Data continuation of application No. PCT/JP2016/062970, filed on Apr. 26, 2016.

(51) Int. Cl.
*F04B 43/04* (2006.01)
*F04B 53/10* (2006.01)

(56) References Cited

U.S. PATENT DOCUMENTS

| | | | |
|---|---|---|---|
| 2011/0070109 | A1 | 3/2011 | Kanai et al. |
| 2013/0058809 | A1 | 3/2013 | Hirata et al. |
| 2013/0058819 | A1 | 3/2013 | Kodama et al. |
| 2013/0266461 | A1 | 10/2013 | Hirata et al. |
| 2015/0023821 | A1 | 1/2015 | Campbell et al. |
| 2015/0071797 | A1 | 3/2015 | Takeuchi |

FOREIGN PATENT DOCUMENTS

| | | | |
|---|---|---|---|
| CN | 103140674 | A | 6/2013 |
| DE | 22 18 524 | A1 | 10/1973 |
| EP | 2 568 177 | B1 | 10/2015 |
| JP | S52-23345 | B2 | 6/1977 |
| JP | S57-8385 | U | 1/1982 |
| JP | 2001-157433 | A | 6/2001 |
| JP | 2004-308465 | A | 11/2004 |
| JP | 2007-092677 | A | 4/2007 |
| JP | 2008-192944 | A | 8/2008 |
| JP | 2010-063321 | A | 3/2010 |
| JP | 2013-068215 | A | 4/2013 |
| JP | 2014-055989 | A | 3/2014 |
| WO | 2013/187270 | A1 | 12/2013 |

* cited by examiner

Prior Art

PUMP

CROSS REFERENCE TO RELATED APPLICATION

This is a continuation of U.S. patent application Ser. No. 15/795,341 filed on Oct. 27, 2017, which is a continuation of International Application No. PCT/JP2016/062970 filed on Apr. 26, 2016 which claims priority from Japanese Patent Application No. 2015-090170 filed on Apr. 27, 2015. The contents of these applications are incorporated herein by reference in their entireties.

BACKGROUND

1. Technical Field

Some embodiments of the present disclosure relate to a pump that sucks and discharges fluid.

2. Description of Related Art

FIG. 12 is a conceptual view of a conventional pump 101 (see Japanese Unexamined Patent Application Publication No. JP2013-068215A, for example).

The pump 101 shown in FIG. 12 is provided with a pump housing 102 and a vibrating portion 103. The pump housing 102 interiorly has a pump chamber 106 and a flow path 107. The vibrating portion 103 is housed in the pump chamber 106, faces a connection portion (opening) 108 of the flow path 107 to the pump chamber 106 with a spacing between each other, and is adjacent to the opening 108. The vibrating portion 103 is elastically coupled to the pump housing 102 so as to vibrate in a direction opposite to the opening 108. The vibrating portion 103 is provided with a driving portion 104, and the driving portion 104 vibrates the vibrating portion 103 in the direction opposite to the opening 108.

SUMMARY

In the conventional pump 101, an impact load is added to the pump housing 102, so that inertial force works on the vibrating portion 103 and thus excessive displacement may occur in the vibrating portion 103. Then, tensile stress exceeding a yield point acts on the vibrating portion 103, and the vibrating portion 103 may plastically deform. Accordingly, in the pump 101, when the impact load is applied, a failure or characteristic degradation might occur.

In particular, in a case of a biological information acquisition device that is often carried and used, there is a high possibility that the biological information acquisition device is dropped out of carelessness and the impact load is then applied to a pump provided in the biological information acquisition device. The biological information acquisition device may be, for example, a wrist type sphygmomanometer In view of the foregoing, the present disclosure is directed to a pump with improved impact resistance.

A pump according to some embodiments of the present disclosure includes: a pump housing internally including a pump chamber; a vibrating portion being supported against the pump housing in the pump chamber, dividing the pump chamber into a first pump chamber and a second pump chamber each including an inner wall, and being driven so as to bend and vibrate in a predetermined direction; and a displacement regulating portion projecting from the inner wall of the first pump chamber and facing the vibrating portion. The vibrating portion is configured by a driving portion and a vibrating plate, for example. The driving portion may be a piezoelectric element, for example.

In this configuration, even when the vibrating portion is about to be excessively displaced by the impact load or the like, displacement of the vibrating portion is regulated by the displacement regulating portion. Therefore, the vibrating portion may be prevented from being displaced excessively, and thus the failure of the pump or a large reduction in pump efficiency due to large plastic deformation of the vibrating portion may be prevented. Accordingly, the impact resistance of the pump is improved.

It is to be noted that the pump according to the present disclosure may be provided with a displacement regulating portion projecting from the inner wall of the second pump chamber and facing the vibrating portion.

The displacement regulating portion may be positioned in a space in which the vibrating portion may be positioned when the vibrating portion elastically deforms. This elastic deformation, for example, is deformation also including unintended movement due to physical impact. In this configuration, the vibrating portion may be prevented from plastically deforming. The displacement regulating portion preferably is not positioned in a space that will interfere with the vibrating portion when the driving portion drives the vibrating portion and causes the vibrating portion to bend and vibrate. In this configuration, it is possible to prevent (reduce) the displacement regulating portion from interfering with the vibrating portion when it bends and vibrates.

The pump may include: a flat plate-shaped member configuring the displacement regulating portion, and the pump is configured as a laminate of a plurality of flat plate-shaped members; and the flat plate-shaped member includes: a supporting portion projecting from the side of the pump housing to the pump chamber; and a projecting portion projecting from the supporting portion to the side of the vibrating portion. In this configuration, since the flat plate-shaped members are stacked to configure a pump, it is easy to manufacture a pump and it is possible to make the pump thin.

The flat plate-shaped member may further include an internal connection terminal extending and projecting from the side of the pump housing to the pump chamber and having a tip connected to the vibrating portion. In this configuration, the flat plate-shaped member configuring the displacement regulating portion serves as a member for performing power supply to the vibrating portion, so that it is possible to reduce the number of flat plate-shaped members and further make the pump thin.

The vibrating portion may bend and vibrate in a high-order resonance mode. In this configuration, it is possible to reduce the amplitude of vibration in the outer peripheral portion of the vibrating portion and to make the vibration of the vibrating portion hard to leak to the pump housing.

In addition, the displacement regulating portion may face a position to be a node of the bending vibration of the vibrating portion without facing the center portion of the vibrating portion. In this configuration, even when the vibrating portion bends and vibrates, a distance between the displacement regulating portion and the vibrating portion is almost unchanged may be constant. Therefore, it is possible to prevent the flow of fluid from being blocked due to changes in the distance between the displacement regulating portion and the vibrating portion.

Alternatively, the displacement regulating portion may face the outer peripheral portion of the vibrating portion without facing the center portion of the vibrating portion.

The pump of this configuration is able to prevent the displacement regulating portion from blocking the flow of fluid near the substantial portion of the vibrating portion. Moreover, the supporting portion provided with the displacement regulating portion may be comparatively short and hard to vibrate. Therefore, the pump of this configuration may prevent the flow of fluid being blocked due to the vibration of the displacement regulating portion.

Alternatively, the displacement regulating portion may face a position to be an antinode of the bending vibration of the vibrating portion without facing the center portion of the vibrating portion. In this configuration, even when abnormal drive power works on the driving portion and the vibrating portion is about to be excessively displaced, the displacement of the vibrating portion may be regulated by the displacement regulating portion. Therefore, the pump of this configuration may prevent the vibrating portion from being displaced excessively, and thus the failure of the pump or a large reduction in pump efficiency due to large plastic deformation of the vibrating portion may be prevented. Accordingly, the pump of this configuration may increase a rated input.

The rated input is the maximum value of the input with which the pump does not fail. For example, in a case in which the pump is driven with a voltage, the rated input is the maximum value of the voltage with which the pump does not fail.

The pump, as the displacement regulating portion, may include a plurality of displacement regulating portions that are aligned at intervals from each other. In this configuration, when the displacement regulating portion and the vibrating portion are in contact with each other, it is possible to prevent (reduce) the inclination of the vibrating portion. In addition, it is also possible to reduce an area in which the displacement regulating portion and the vibrating portion face each other and to more reliably prevent the flow of fluid being blocked by the displacement regulating portion.

The pump may be provided with three or more displacement regulating portions as the displacement regulating portion. Since the vibrating portion becomes in parallel with a plane connecting the three or more displacement regulating portions when contacting the displacement regulating portion, the pump of this configuration is able to more reliably prevent the vibrating portion from inclining.

Furthermore, the center of gravity of the vibrating portion may fall inside the three or more displacement regulating portions. Since at least one or more of the displacement regulating portions regulate the inclination of the vibrating portion, the pump of this configuration is able to more reliably prevent the inclination of the vibrating portion.

According to various embodiments of the present disclosure, a displacement regulating portion makes it is possible to prevent a vibrating portion from being displaced excessively when an impact load or the like acts on a pump, thereby improving the impact resistance of the pump.

BRIEF DESCRIPTION OF THE DRAWINGS

FIG. 11A shows a case in which fluid flows in a forward direction, and FIG. 11B shows a case in which fluid flows in a reverse direction.

DETAILED DESCRIPTION

Hereinafter, a plurality of embodiments of a pump according to the present disclosure will be described by taking a case in which an air pump that sucks and discharges gas is configured as an example. It is to be noted that the pump according to the present disclosure may be an air pump or a pump that generates a flow of another fluid such as liquid, vapor-liquid mixed fluid, gas-solid mixed fluid, solid-liquid mixed fluid, gel, or gel mixing fluid.

First Embodiment

First, a description will be made of the schematic configuration of a pump according to a first embodiment of the present disclosure.

Figure 1:
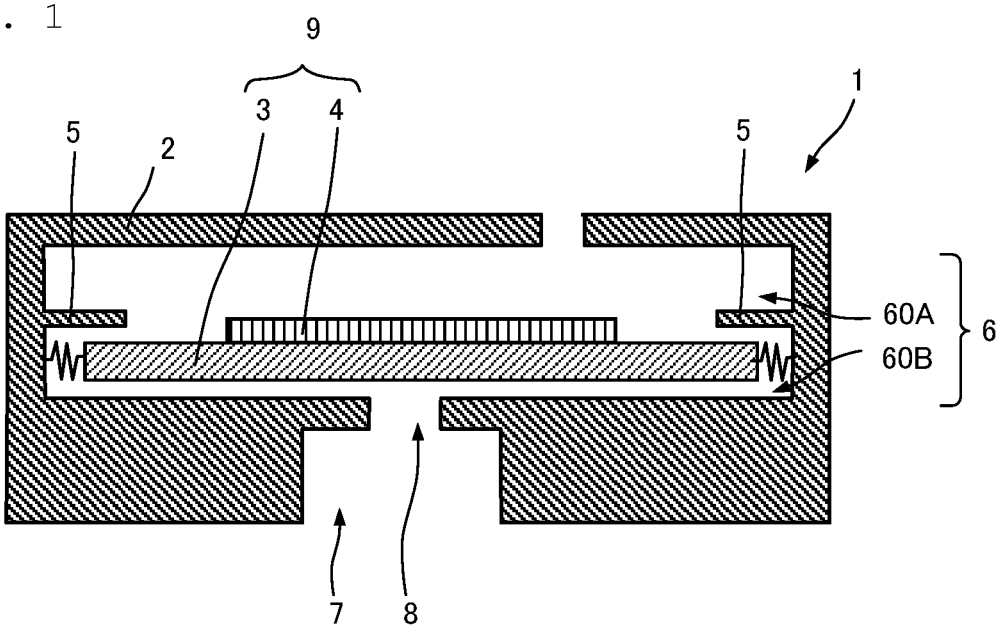
FIG. 1 is a schematic cross-sectional view of a pump 1 according to a first embodiment of the present disclosure.

FIG. 1 is a schematic cross-sectional view of a pump 1 according to the first embodiment of the present disclosure.

The pump 1 is provided with a pump housing 2, a vibrating plate 3, a driving portion 4, and a displacement regulating portion 5. The pump housing 2 is a cube internally having a pump chamber 6 and a flow path 7. The flow path 7 has an opening 8 connected to the pump chamber 6. The vibrating plate 3 and the driving portion 4 are integrally stacked and form a vibrating portion 9. The vibrating portion 9 is housed in the pump chamber 6, and is adjacent to and faces the opening 8 with a spacing between the vibrating portion 9 and the opening 8. The vibrating portion 9 may have a circular shape in a plan view. The vibrating portion 9 is elastically linked to the pump housing 2 so as to be displaceable in a direction facing the opening 8, and generates vibration in the direction facing the opening 8 when a drive voltage is applied to the driving portion 4. The vibrating portion 9 divides the pump chamber 6 into a first pump chamber 60A and a second pump chamber 60B. The displacement regulating portion 5 projects from the inner wall of the pump chamber 6 and faces the vibrating portion 9 with a spacing between the displacement regulating portion 5 and the vibrating portion 9, on a side opposite to the opening 8. The displacement regulating portion 5 may extend from the inner wall of the first pump chamber 60A along the entire circumference of the inner wall or a portion of the circumference.

When inertial force works on the vibrating portion 9 by the action of an impact load or the like, excessive displacement of the vibrating portion 9 may be regulated by the displacement regulating portion 5. Accordingly, it is possible to reduce large plastic deformation of the vibrating portion 9 and achieve the high impact resistance of the pump 1.

The displacement regulating portion 5 may be positioned in a space of the pump chamber 6 in which the vibrating portion 9 is may be positioned when the vibrating portion 9 elastically deforms. The displacement regulating portion 5 may be positioned in a range where the vibrating portion 9 is able to keep the elastic deformation. This elastic deformation, for example, is deformation also including unintended movement due to physical impact. Accordingly, tensile stress exceeding a yield point does not act on the vibrating plate 3, so that the plastic deformation of the vibrating plate 3 may be prevented.

The displacement regulating portion 5 is preferably not positioned in the space of the pump chamber 6 that will interfere with the vibrating portion 9 when the vibrating portion 9 bends and vibrates by the normal drive of the driving portion 4. This space is a space in which, when the driving portion 4 drives the vibrating plate 3 and deforms the vibrating plate 3, both the driving portion 4 and the vibrating plate 3 are able to move. Accordingly, the displacement regulating portion 5 will not interfere with (contact) the vibrating portion 9 as it vibrates by the normal drive of the driving portion 4, thereby preventing (reducing) the vibration of the vibrating portion 9 from being blocked.

Therefore, this pump 1 has a high impact resistance, and, even when an impact load or the like acts on the pump 1, a failure or characteristic degradation may be prevented.

As shown in FIG. 1, the displacement regulating portion 5 may be closer to the vibrating plate 3 than to the driving portion 4. This is because, while the driving portion 4 is generally made of an impact-sensitive material such as a piezoelectric body, the vibrating plate 3 has a spring property and is often made of an impact-resistant metal material. Thus, the pump 1 is able to more reliably prevent the breakage of the vibrating portion 9.

In a case in which the displacement regulating portion 5 is adjacent to the driving portion 4, as shown in FIG. 1, the vibrating plate 3 may be attached to the entire lower principal surface of the driving portion 4. Accordingly, the pump 1 may more reliably prevent the breakage of the vibrating portion 9.

Hereinafter, a description is made of the pump according to a second embodiment of the present disclosure.

Second Embodiment

Figure 2:
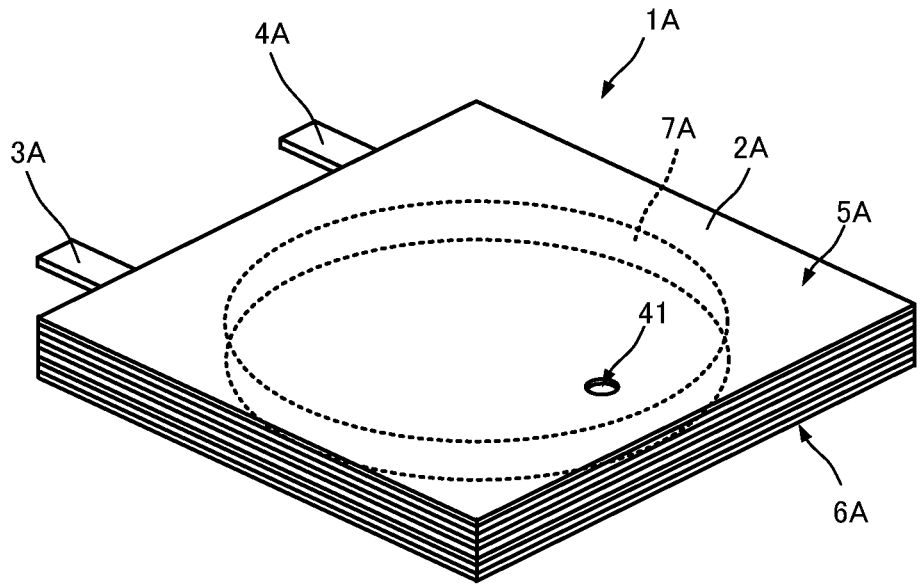
FIG. 2 is an external perspective view of a pump 1A according to a second embodiment of the present disclosure.

FIG. 2 is an external perspective view of a pump 1A according to a second embodiment of the present disclosure.

The pump 1A is provided with a pump housing 2A and external connection terminals 3A and 4A. The external connection terminals 3A and 4A are connected to an external power source, and an alternating current drive signal is applied to the external connection terminals 3A and 4A. The pump housing 2A has a first principal surface (upper principal surface) 5A and a second principal surface (lower principal surface) 6A, and may be a hexahedron (such as, a cube) having a thin body between the upper principal surface 5A and the lower principal surface 6A. In addition, the pump housing 2A internally has a pump chamber 7A, a flow path hole 41 leading to the pump chamber 7A on the upper principal surface 5A, and a flow path hole 31 (see FIG. 3) leading to the pump chamber 7A on the lower principal surface 6A.

Figure 3:
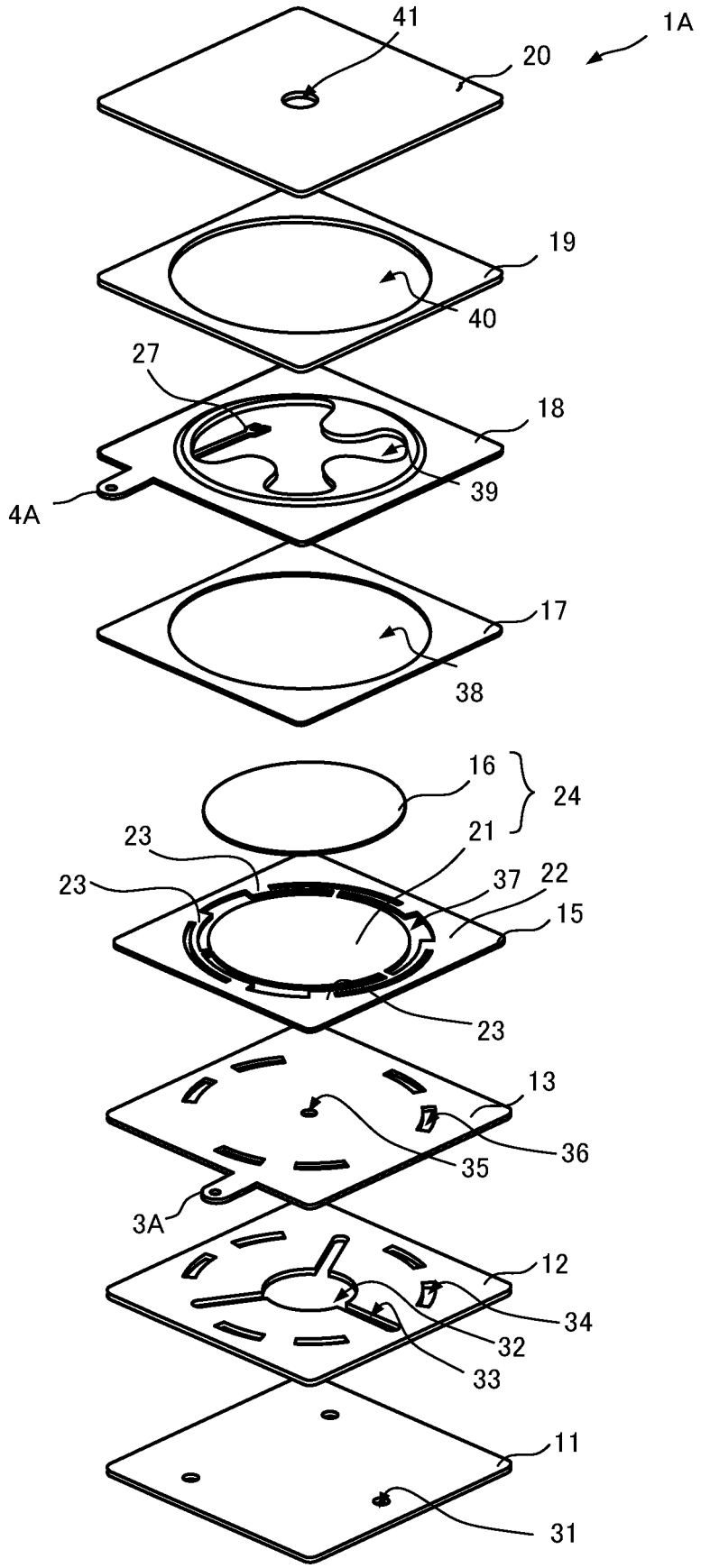
FIG. 3 is an exploded perspective view of the pump 1A.

FIG. 3 is an exploded perspective view of the pump 1A. The pump 1A is provided with components including a cover plate 11, a flow path plate 12, a facing plate 13, an adhesive layer (not shown), a vibrating plate 15, a piezoelectric element 16, an insulating plate 17, a power feeding plate 18, a spacer plate 19, and a lid plate 20, which are stacked from the lower principal surface 6A to the upper principal surface 5A in order.

The cover plate 11, the flow path plate 12, and the facing plate 13 include a flow path leading to the flow path hole 31 of the lower principal surface 6A (see FIG. 2). The pump chamber 7A (FIG. 2) is defined by the adhesive layer (not shown), the vibrating plate 15, the insulating plate 17, the power feeding plate 18, and the spacer plate 19. The lid plate 20 includes a flow path leading to the flow path hole 41 of the upper principal surface 5A (FIG. 2).

The cover plate 11 has three flow path holes 31. Each of the flow path holes 31 is circle-shaped, and functions as an air intake hole that opens to the lower principal surface 6A of the pump housing 2 and sucks gas from an external space. In addition, the three flow path holes 31 are positioned away from the center position of the cover plate 11 in a plan view. More specifically, each of the flow path holes 31 is arranged so that the angles formed by a line segment, connecting each of the flow path holes 31 and the center position, are equal angles.

The flow path plate 12 has one opening 32, three flow paths 33, and six adhesive sealing holes 34. The opening 32 is provided in a circular shape with a comparatively large area around the center position of the flow path plate 12. The opening 32 is covered with the cover plate 11 from a bottom surface side and in communication with a flow path hole 35 of the facing plate 13 to be described below at a top surface side.

The three flow paths 33 each extend in a radial direction from the opening 32 of the flow path plate 12. The three flow paths 33 each is long in a radical direction and narrow in a circumferential direction of the opening 32. A first end of each of the flow paths 33 is in communication with the opening 32. A second end of each of the flow paths 33 is in communication with one of the three flow path holes 31 of the cover plate 11. The upper side of each of the three flow path holes 33 except for the second end is covered with the facing plate 13. The lower sides of each of the flow paths 33 except for the second end is covered with the cover plate 11.

The six adhesive sealing holes 34 are arranged with a spacing between each other along the outer periphery of the pump chamber 7A (see FIG. 2). More specifically, each of the adhesive sealing holes 34 extends along the outer periphery of the pump chamber 7A so as to face a position in which a frame portion 22 of the vibrating plate 15 and a link portion 23 to be described below are connected to each other. Each of the adhesive sealing holes 34 is covered with the cover plate 11 from a bottom surface side and in communication with an adhesive sealing hole 36 of the facing plate 13 to be described below at a top surface side.

The facing plate 13 is made of metal, and is provided with an external connection terminal 3A so as to project outward from the outer peripheral edge. In addition, the facing plate 13 has one flow path hole 35 and six adhesive sealing holes 36.

The flow path hole 35 is provided in a circular shape with a diameter smaller than the opening 32 of the flow path plate 12, around the center position of the facing plate 13. The flow path hole 35 is in communication with the opening 32 of the flow path plate 12 at a bottom surface side and is in communication with the pump chamber 7A (see FIG. 2) at a top surface side.

The six adhesive sealing holes 36 are arranged with a spacing between each other along the outer periphery of the pump chamber 7A (see FIG. 2). More specifically, each of the adhesive sealing holes 36 extends along the outer periphery of the pump chamber 7A so as to face a position in which the frame portion 22 of the vibrating plate 15 and the link portion 23 to be described below are connected to each other. Each of the adhesive sealing holes 36 is in communication with each of the adhesive sealing holes 34 of the flow path plate 12 at a bottom surface side and faces the adhesive layer (not shown) at a top surface side.

The adhesive sealing holes 34 and 36 may prevent the adhesive layer (not shown) in an uncured state from overflowing into the pump chamber 7A (see FIG. 2) and adhering to the link portion 23 of the vibrating plate 15. When the adhesive layer in an uncured state adheres to the link portion 23, the vibration of the link portion 23 is blocked, thus causing variation in the characteristics of each product. Accordingly, the adhesive sealing holes 34 and 36 are provided so as to cause overflowing adhesives to flow into the adhesive sealing holes 34 and 36, which prevents the adhesive layer 14 from overflowing into the pump chamber 7A and also reduces the variation in the characteristics of each product.

The adhesive layer (not shown) is provided in a frame shape having a circular opening in a plan view so as to overlap with the frame portion 22 of the vibrating plate 15. The space surrounded by the frame of the adhesive layer defines a portion of the pump chamber 7A (see FIG. 2). The adhesive layer is configured by containing a plurality of conductive particles each having a substantially uniform particle diameter in a thermosetting resin such as an epoxy resin. Each of the conductive particles may be configured as silica or resin coated with a conductive metal, for example. In this manner, since the adhesive layer contains the plurality of conductive particles, the thickness of the entire circumference of the adhesive layer is substantially matched with the particle diameter of the conductive particle, and may be made uniform. Therefore, the adhesive layer may cause the facing plate 13 and the vibrating plate 15 to face each other with a constant spacing between the facing plate 13 and the vibrating plate 15. In addition, the facing plate 13 and the vibrating plate 15 may be electrically connected to each other through the conductive particles of the adhesive layer.

Figure 4A:
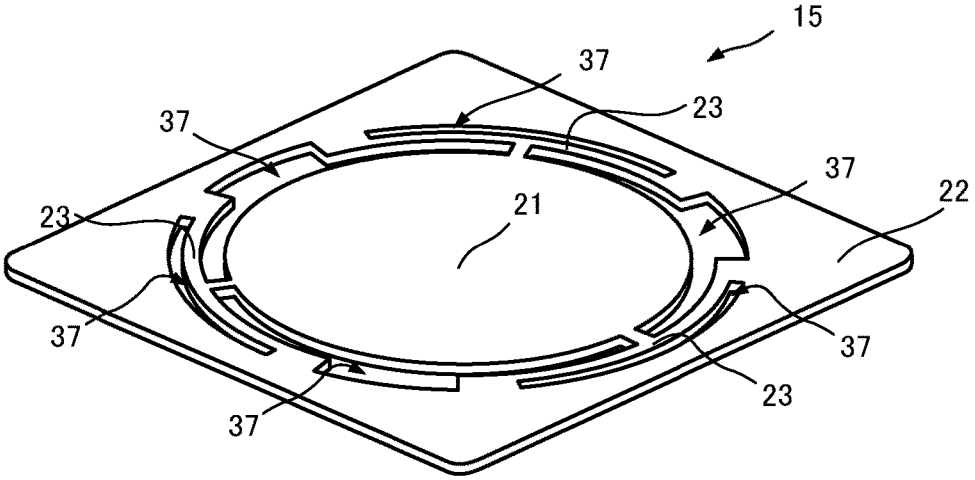
FIG. 4A is a top perspective view of a vibrating plate 15.
Figure 4B:
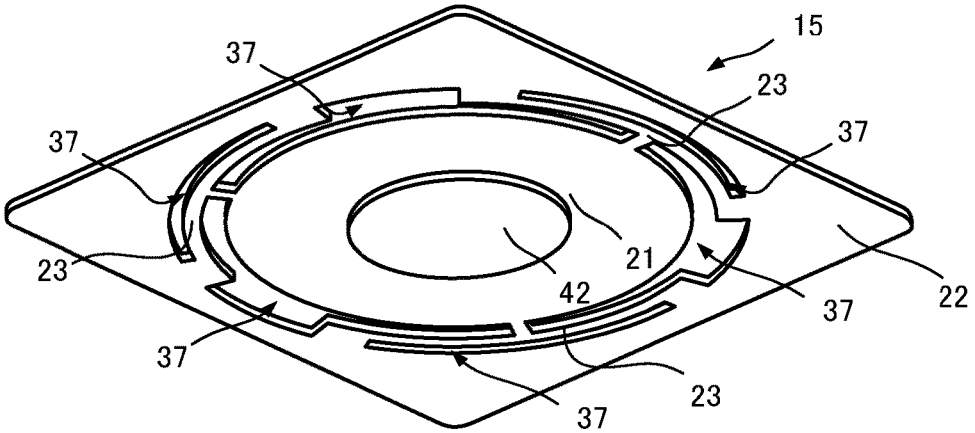
FIG. 4B is a bottom perspective view of the vibrating plate 15.

The vibrating plate 15 may be made of metal such as SUS 430, for example. FIG. 4A is a top perspective view of the vibrating plate 15. FIG. 4B is a bottom perspective view of the vibrating plate 15.

The vibrating plate 15 includes a circular plate portion 21, a frame portion 22, three link portions 23, and a plurality of openings 37 surrounded by the circular plate portion 21, the frame portion 22, and the link portions 23. The plurality of openings 37 defines a portion of the pump chamber 7A (see FIG. 2). The circular plate portion 21 has a circular shape in a plan view. The frame portion 22 has a frame shape provided with a circular opening in a plan view, and surrounds the circular plate portion 21 with a spacing between the frame portion 22 and the circular plate portion 21. Each of the link portions 23 links the circular plate portion 21 and the frame portion 22. The circular plate portion 21 is supported against the link portions 23 in a state of floating inside the pump chamber 7A (see FIG. 2).

The bottom surface (see FIG. 4B) of the circular plate portion 21 has a convex portion 42 in which a circular region is configured in a convex shape in the vicinity of or adjacent to the central portion of the bottom surface of the circular plate portion 21. By providing the convex portion 42 on the bottom surface of the circular plate portion 21, the convex portion 42 is adjacent to the flow path hole 35 of the facing plate 13, which may increase the pressure fluctuation of fluid that is generated accompanying vibration of the circular plate portion 21. In addition, in a region in which the convex portion 42 is not provided, the spacing between the circular plate portion 21 and the facing plate 13 is increased. Since the region in which the convex portion 42 is not provided is a region that does not contribute to a pump operation directly, by increasing the space between the circular plate portion 21 and the facing plate 13 in this region, the driving load of the piezoelectric element 16 may be reduced and the pressure of fluid and the flow amount generated by the pump operation may be improved along with a pump efficiency. It is to be noted that, while the convex portion 42 in the illustrated example is provided on the bottom surface of the circular plate portion 21, the bottom surface of the circular plate portion 21 may be made into a flat shape, and the circumference of the flow path hole 35 may be made into a convex shape with respect to the facing plate 13 facing the circular plate portion 21.

The link portions 23 are each approximately T-shaped, and are arranged with a spacing in an equiangular direction between each other. Specifically, each of the link portions 23 has an end on the side of the center of the vibrating plate 15, the end being linked with the circular plate portion 21. Each of the link portions 23 extends from the circular plate portion 21 in a radial direction, splits into two forks, extends along the outer periphery of the pump chamber 7A, bends towards the frame portion 22, reaches the frame portion 22, and is linked with the frame portion 22. Since each of the link portions 23 has such a shape, the edge of the circular plate portion 21 is supported against the frame portion 22 so as to be displaceable in the vertical direction and prevent displacement in a plane direction.

The piezoelectric element 16 shown in FIG. 3 is configured by providing electrodes on the top and bottom surfaces of a circular plate made of a piezoelectric material. The electrode on the top surface of the piezoelectric element 16 is electrically connected to an external connection terminal 4A through the power feeding plate 18. The electrode on the bottom surface of the piezoelectric element 16 is electrically connected to an external connection terminal 3A through the vibrating plate 15, the adhesive layer 14, and the facing plate 13. In some examples, the electrode on the bottom surface of the piezoelectric element 16 may not be provided and may be replaced by the vibrating plate 15 made of metal. This piezoelectric element 16, when an electric field is applied in the thickness direction of the piezoelectric element 16, has a piezoelectric property such that an area may be increased or reduced in the in-plane direction. The use of the piezoelectric element 16 may permit the vibrating portion 24 to be thin and may downsize the pump 1.

The piezoelectric element 16 may be attached to the circular plate portion 21 with an adhesive or the like. The vibrating portion 24 may be defined by the piezoelectric element 16 and the circular plate portion 21, and is configured so as to generate bending vibration in the vertical direction when the area vibration of the piezoelectric element 16 is restrained by the circular plate portion 21. Since the outer peripheral portion of the circular plate portion 21 is supported by the link portion 23 so as to be vertically displaceable as described above, the bending vibration that is generated in the vibrating portion 24 is hardly blocked by the link portion 23. Also, since the vibrating portion 24 is displaceable in the vertical direction, when an impact load or acceleration acts on the pump 1A, displacement in the vertical direction may occur in the vibrating portion 24.

The insulating plate 17 has a frame shape with a circular opening 38 in a plan view. The opening 38 defines a portion of the pump chamber 7A (see FIG. 2). The insulating plate 17 is made of an insulating resin and insulates electrically between the power feeding plate 18 and the vibrating plate 15. This makes it possible to apply a driving voltage to the electrodes of the top and bottom surfaces of the piezoelectric element 16 through the power feeding plate 18 and the vibrating plate 15. The power feeding plate 18 and the vibrating plate 15 may be insulated, other than by providing the insulating plate 17, by coating the surface of the vibrating plate 15 or the power feeding plate 18 with an insulating material or by providing an oxide layer on the surface of the vibrating plate 15 or the power feeding plate 18.

Figure 5A:
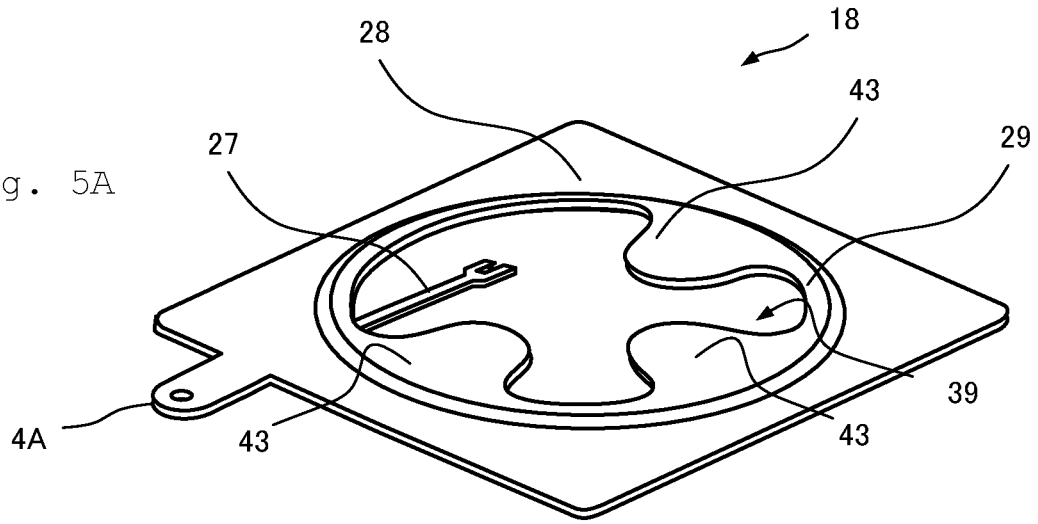
FIG. 5A is a top perspective view of a power feeding plate 18.
Figure 5B:
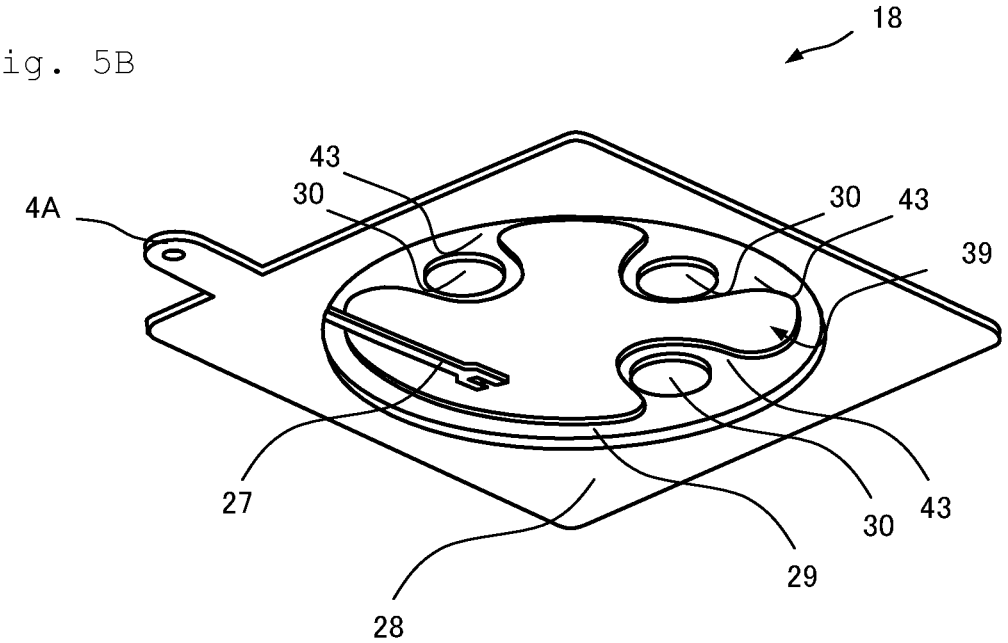
FIG. 5B is a bottom perspective view of the power feeding plate 18.

The power feeding plate 18 is metal. FIG. 5A is a top perspective view of the power feeding plate 18. FIG. 5B is a bottom perspective view of the power feeding plate 18.

The power feeding plate 18 is provided with an external connection terminal 4A, an internal connection terminal 27, a frame portion 28, a supporting portion 29, displacement regulating portions 30, and an opening 39 surrounded by the supporting portion 29. The opening 39 defines a portion of the pump chamber 7A (see FIG. 2). The internal connection terminal 27 projects from the frame portion 28 to the opening 39, and has a tip soldered to the electrode of the top surface of the piezoelectric element 16.

The supporting portion 29 has a circular outside shape in a plan view and has a frame shape that surrounds the opening 39. The frame portion 28 has a frame shape that surrounds the supporting portion 29 in a plan view. The power feeding plate 18 has a level difference between the supporting portion 29 and the frame portion 28 such that the supporting portion 29 is recessed more than the frame portion 28 on the bottom surface of the power feeding plate 18, and the frame portion 28 is recessed from the supporting portion 29 on the top surface of the power feeding plate 18. Since the amplitude of oscillation is reduced due to air resistance when the top surface of the piezoelectric element 16 excessively approaches the supporting portion 29, the supporting portion 29 is recessed more than the frame portion 28 on the bottom surface of the power feeding plate 18 in order to prevent the piezoelectric element 16 from excessively approaching the supporting portion 29.

The supporting portion 29 has three wave-shaped portions 43 that project toward the opening 39 (i.e., toward the center of the supporting portion 29). Each of the wave-shaped portions 43 is continuously arranged in a wavelike manner in a plan view. The three wave-shaped portions 43 are respectively provided in three of the four regions obtained by dividing the opening 39 into four regions at equal angles. Meanwhile, the tip of the internal connection terminal 27 is positioned in the one remaining region of the four regions.

Each of the wave-shaped portions 43 includes a respective one of the displacement regulating portions 30 provided on its bottom surface (see FIG. 5B). Each of the displacement regulating portions 30 has a circular shape in a plan view and projects downward from the bottom surface of its corresponding wave-shaped portion 43. Each of the displacement regulating portions 30 is provided in order to prevent the link portion 23 of the vibrating plate 15 from excessively extending, by contacting the top surface of the piezoelectric element 16 at the time of the action of the impact load or the like. The bottom surface of each of the displacement regulating portions 30 is provided with a height that does not interfere with the bending vibration of the vibrating portion 24.

The displacement regulating portions 30 may have a planar shape. When the excessive displacement of the vibrating portion 24 is regulated by the displacement regulating portions 30, the impact load is able to be received by a plane, so that the stress concentrated on both the displacement regulating portions 30 and the vibrating portion 24 is relieved. Therefore, the displacement regulating portions 30 having a plane shape is able to prevent both the displacement regulating portions 30 and the vibrating portion 24 from being damaged.

In addition, the spacer plate 19 shown in FIG. 3 is made of a resin and is in a substantially frame shape having a circular opening 40 in a plan view. The opening 40 defines a portion of the pump chamber 7A (see FIG. 2).

The lid plate 20 defines the top surface of the pump chamber 7A (see FIG. 2). The lid plate 20 has a flow path hole 41 that opens to the upper principal surface 5A of the pump housing 2. The flow path hole 41 has a circular shape in a plan view, and is in communication with the external space and also in communication with the opening 40 of the spacer plate 19, that is, the pump chamber 7A. The flow path hole 41 is an exhaust air hole that discharges gas to the external space. While the flow path hole 41 is illustrated as being provided in the center position of the lid plate 20, the flow path hole 41 may be provided in a position away from the center position of the lid plate 20.

Figure 6A:
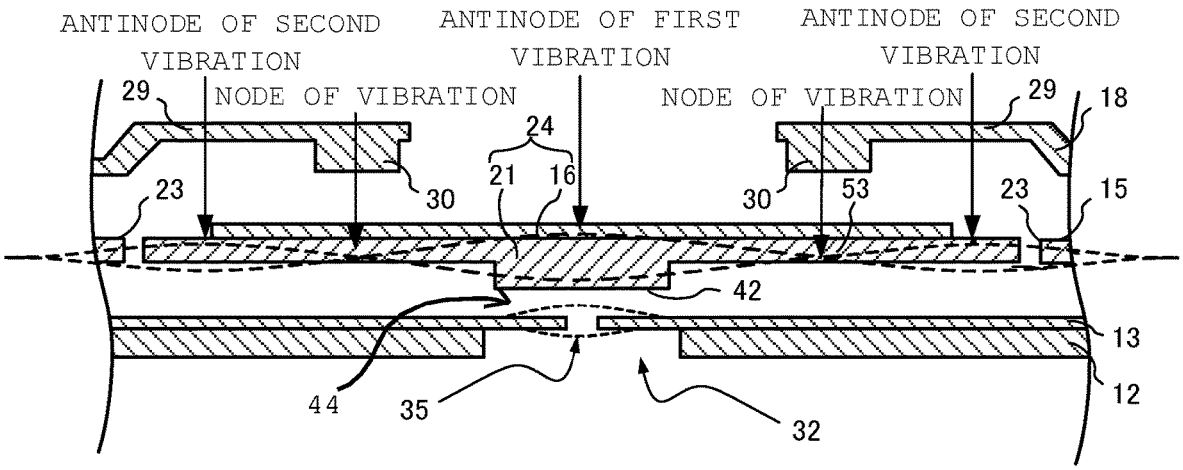
FIG. 6A is a sectional side elevational view of the pump 1A viewed from the power feeding plate 18 to a flow path plate 12, and shows a cross-section taken along a line A-A' in FIG. 6B.
Figure 6B:
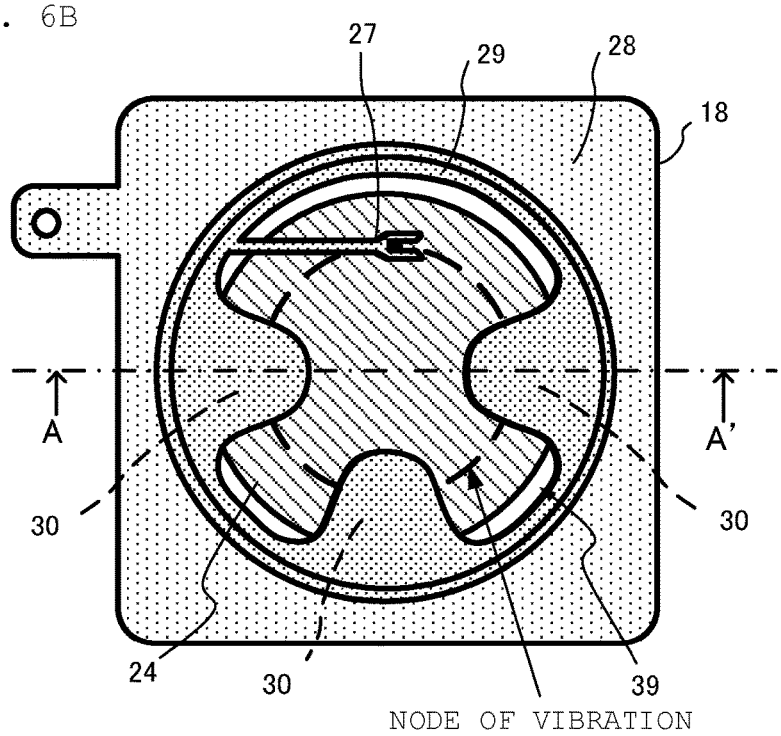
FIG. 6B is a plan view of a vibrating portion 24 and the power feeding plate 18.

FIG. 6A is a sectional side elevational view of the pump 1A viewed from the power feeding plate 18 to the flow path plate 12, and shows a cross-section taken along a line A-A' in FIG. 6B.

In the pump 1A, an alternating current drive signal is applied to the external connection terminals 3A and 4A, so that an alternating electric field is applied in the thickness direction of the piezoelectric element 16. Then, the piezoelectric element 16 tends to evenly expand and contract in the in-plane direction, and thus the bending vibration in the thickness direction is generated concentrically in the vibrating portion 24 of the piezoelectric element 16 and the circular plate portion 21.

The alternating current drive signal applied to the external connection terminals 3A and 4A is set so as to have a frequency that generates in the vibrating portion 24 a bending vibration in a third-order resonance mode. In a case in which the vibrating portion 24 bends and vibrates in the third-order resonance mode, an antinode of a first vibration occurs in the central portion of the vibrating portion 24, an antinode of a second vibration of which the phase is different by 180 degrees from the phase of the first vibration occurs at the outer edge portion of the vibrating portion 24, and a node of vibration occurs in the intermediate portion between the central portion and the outer edge portion of the vibrating portion 24. Thus, if the vibrating portion 24 is bent and vibrated in the high-order (and odd number-order) resonance mode, compared with a case of being bent and vibrated in a first-order resonance mode, vibration is prevented wherein the vibrating portion 24 does not bend but vibrates in the vertical direction, and the amplitude of oscillation in the outer peripheral portion of the vibrating portion 24 becomes smaller and the vibration becomes less likely to leak to the pump housing 2A (see FIG. 2).

The bending vibration occurs in the vibrating portion 24 as described above, so that, in the vibrating portion 24, the convex portion 42 is repeatedly displaced up and down, and the convex portion 42 is repeatedly beaten against a thin fluid layer of a gap between the convex portion 42 and the facing plate 13. Accordingly, repeated pressure fluctuation occurs in the fluid layer that faces the convex portion 42, and the pressure fluctuation is transmitted through fluid to the region (hereinafter will be referred to as a movable portion 44) of the facing plate 13 that faces the convex portion 42. The movable portion 44 is thin, and is configured so as to bend and vibrate. Therefore, the movable portion 44, in response to the bending vibration of the vibrating portion 24, generates bending vibration having the same frequency as and a different phase from the bending vibration of the vibrating portion 24.

The vibration of the vibrating portion 24 and the vibration of the movable portion 44 that are generated in this manner are coupled to each other, and thus, inside of the pump chamber 7A, a distance of the gap between the convex portion 42 and the movable portion 44 varies from a vicinity to an outer periphery side of the flow path hole 35 in the form of traveling waves. Accordingly, fluid comes to flow from the vicinity to the outer periphery side of the flow path hole 35 inside of the pump chamber 7A. Thus, a negative pressure occurs around the flow path hole 35 inside of the pump chamber 7A, causing fluid to be sucked from the flow path hole 35 to the pump chamber 7A, and fluid in the pump chamber 7A to be discharged outside through the flow path hole 41 provided in the lid plate 20.

FIG. 6B is a plan view of a vibrating portion 24 and the power feeding plate 18.

The displacement regulating portions 30 of the power feeding plate 18 are provided so as to face the top surface side of the vibrating portion 24 with a spacing. The displacement regulating portions 30 may face a position in which a node of vibration occurs. Therefore, even when the bending vibration occurs in the vibrating portion 24, the distance between the vibrating portion 24 and the displacement regulating portions 30 is constant. Accordingly, even when the displacement regulating portions 30 are provided, interference with the vibration of the vibrating portion 24 is prevented and thus a good pump efficiency may be achieved.

In addition, the displacement regulating portions 30 are dispersedly provided. Therefore, when the vibrating portion 24 is displaced due to an impact load or the like and the vibrating portion 24 comes into contact with the displacement regulating portion 30, it is possible to prevent inclination of the vibrating portion 24. In addition, it is also possible to reduce an area in which the displacement regulating portions 30 and the vibrating portion 24 face each other and thus prevent the flow of fluid from being blocked by the displacement regulating portions 30.

The tip of the internal connection terminal 27 is soldered to a position being the node of vibration in the vibrating portion 24. In addition, the internal connection terminal 27, with respect to a concentric circular area in which the node of vibration of the piezoelectric element 16 occurs, extends in the tangential direction of the concentric circular area. As a result, it is possible to prevent the vibration from leaking from the piezoelectric element 16 to the internal connection terminal 27, to achieve further improvement in pump efficiency, and also to prevent breakage of the internal connection terminal 27 due to vibration.

Figure 7:
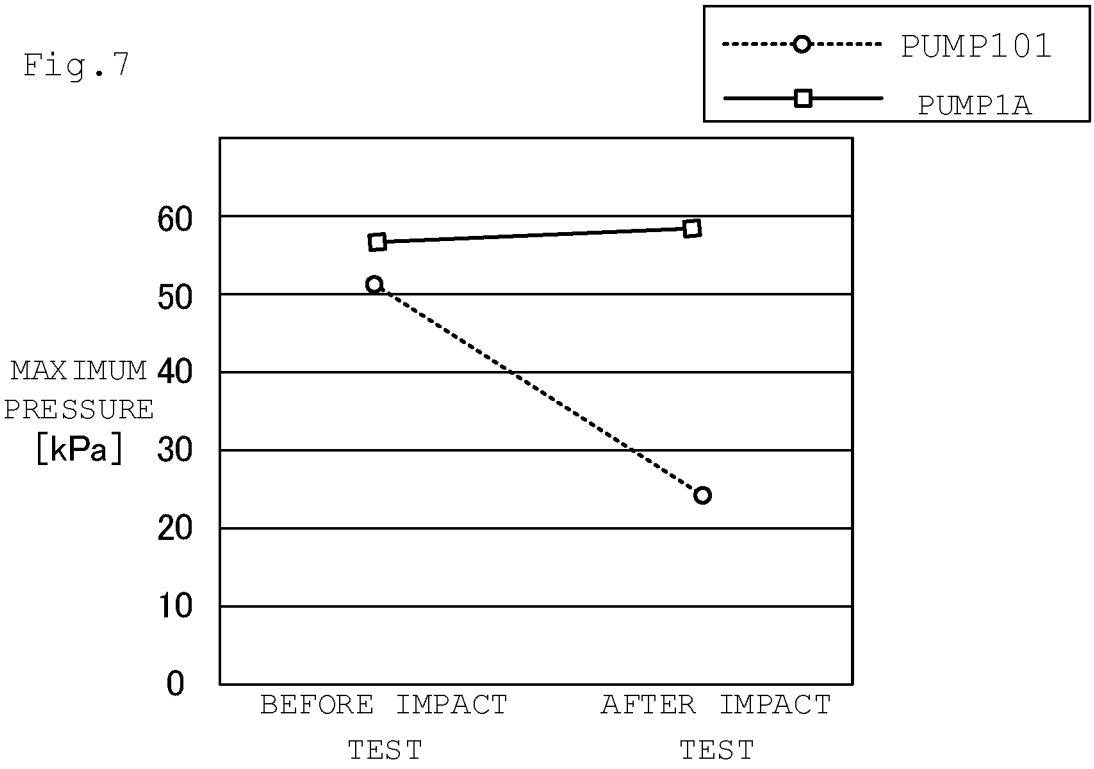
FIG. 7 is a graph showing a change of pump characteristics (the maximum pressure force) before and after an impact test in which samples of the pump 1A according to the second embodiment of the present disclosure and a pump 101 (see FIG. 12) according to a conventional configuration are dropped from the height of 50 cm.
Figure 12:
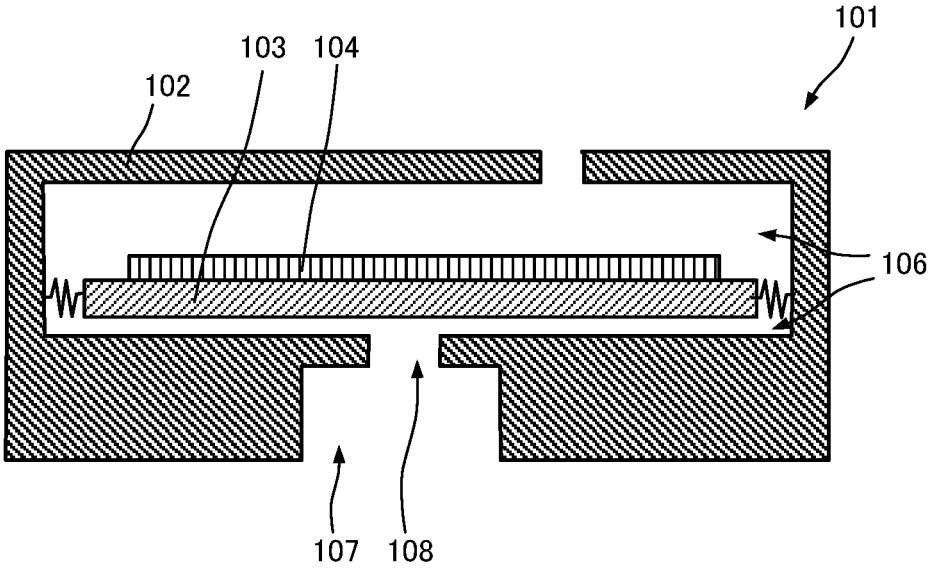
FIG. 12 is a conceptual view of a conventional pump (see Patent Literature 1, for example).

In the pump 1A, even when an impact load or the like acts, it is also possible to regulate excessive displacement of the vibrating portion 24 by the displacement regulating portions 30 and to prevent large plastic deformation of the link portion 23, and thus the impact resistance of the pump 1A becomes high. FIG. 7 is a graph showing a change of pump characteristics (the maximum pressure force) before and after an impact test is performed in which samples of the pump 1A according to the second embodiment and a pump 101 (see FIG. 12) according to a conventional configuration are dropped from the height of 50 cm. In the pump 1A, specific degradation in the pump characteristics before and after the impact test did not occur. Meanwhile, in the pump 101 according to a conventional configuration, serious degradation in the pump characteristics occurred due to the impact test. Thus, the pump 1A has a high impact resistance, and, even when an impact load or the like acts on the pump 1A, a failure or characteristic degradation may be prevented.

Third Embodiment

A description will be made of a pump according to a third embodiment of the present disclosure.

Figure 8A:
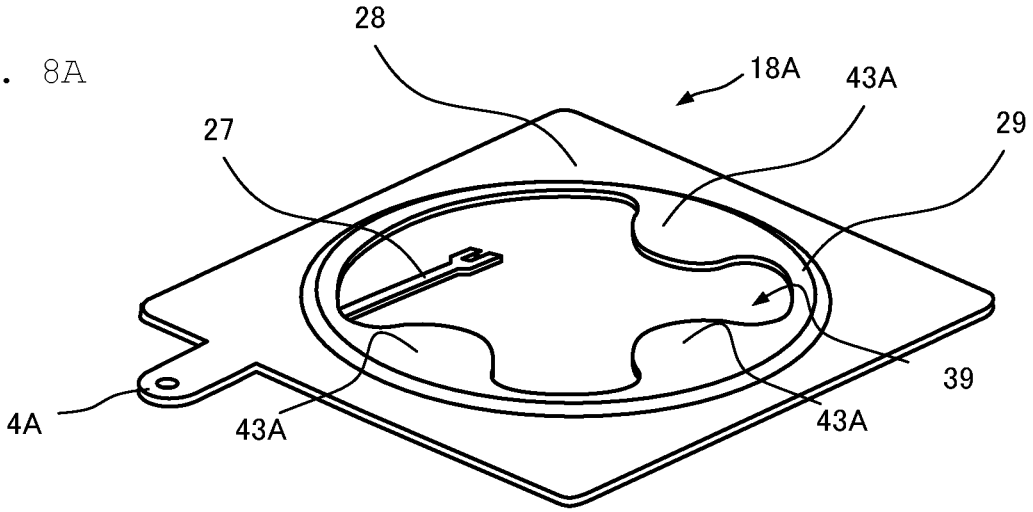
FIG. 8A is a top perspective view of a power feeding plate 18A with which a pump according to a third embodiment is provided.
Figure 8B:
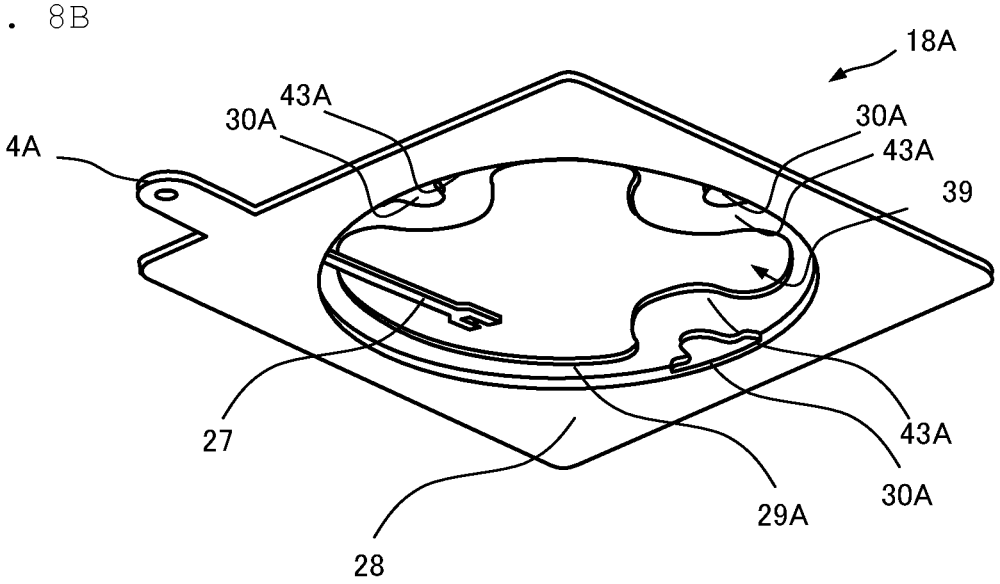
FIG. 8B is a bottom perspective view of the power feeding plate 18A.

FIG. 8A is a top perspective view of a power feeding plate 18A of the pump according to the third embodiment. FIG. 8B is a bottom perspective view of the power feeding plate 18A.

The power feeding plate 18A includes an external connection terminal 4A, an internal connection terminal 27, a frame portion 28, a supporting portion 29A, displacement regulating portions 30A, and an opening 39A surrounded by the supporting portion 29A. In the third embodiment, the configuration of the external connection terminal 4A, the internal connection terminal 27, and the frame portion 28 is substantially the same as the configuration according to the second embodiment, whereas the configuration of the supporting portion 29A, the displacement regulating portions 30A, and the opening 39A is different from the configuration according to the second embodiment. Specifically, the displacement regulating portions 30A are mountain-shaped and provided along the outer peripheral portion of the supporting portion 29A. The supporting portion 29A is provided with three wave-shaped portions 43A, and the wave-shaped portions 43A have smaller unevenness as compared with the configuration according to the second embodiment. The opening 39A has an area that is enlarged by only a portion in which the unevenness of the wave-shaped portion 43A is smaller.

Figure 9:
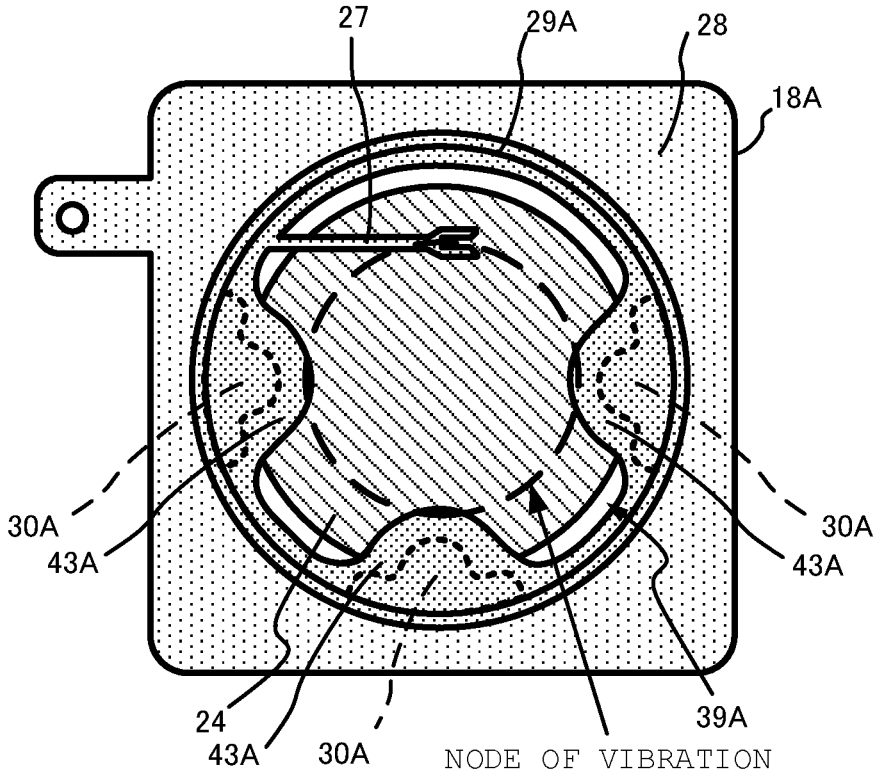
FIG. 9 is a plan view of the power feeding plate 18A and the vibrating portion 24.

FIG. 9 is a plan view of the power feeding plate 18A and the vibrating portion 24.

The displacement regulating portions 30A of the power feeding plate 18A are provided so as to face the top surface side of the vibrating portion 24 with a spacing, so as not to face the outer peripheral portion of the vibrating portion 24 outside the node of vibration of the vibrating portion 24. In this configuration, since the displacement regulating portions 30A are provided at a position outside the position of the second embodiment, the unevenness of the wave-shaped portion 43A is able to be reduced. In other words, the dimension of the wave-shaped portion 43A in the radial direction of the power feeding plate 18A may be shortened. Accordingly, the vibration in the thickness direction of the wave-shaped portion 43A that blocks the flow of fluid may be prevented, and the flow of fluid is facilitated.

The decision of whether the displacement regulating portions should face the outer peripheral portion of the vibrating portion as in the third embodiment or whether the displacement regulating portions should face the node of vibration in the vibrating portion as in the second embodiment may be based on which one of the effect of blocking the flow of fluid by vibration of the wave-shaped portion (supporting portion) and the effect of blocking the flow of fluid by variation of a distance between the displacement regulating portions and the vibrating portion is larger.

In the pump according to the third embodiment, since excessive displacement of the vibrating portion 24 is also regulated by the displacement regulating portions 30A even when an impact load or the like acts on the pump, the impact resistance of the pump is increased and, even when such an impact load or the like acts on the pump, a failure or characteristic degradation is less likely to occur.

Fourth Embodiment

Subsequently, a description will be made of a fourth embodiment of the present disclosure.

Figure 10:
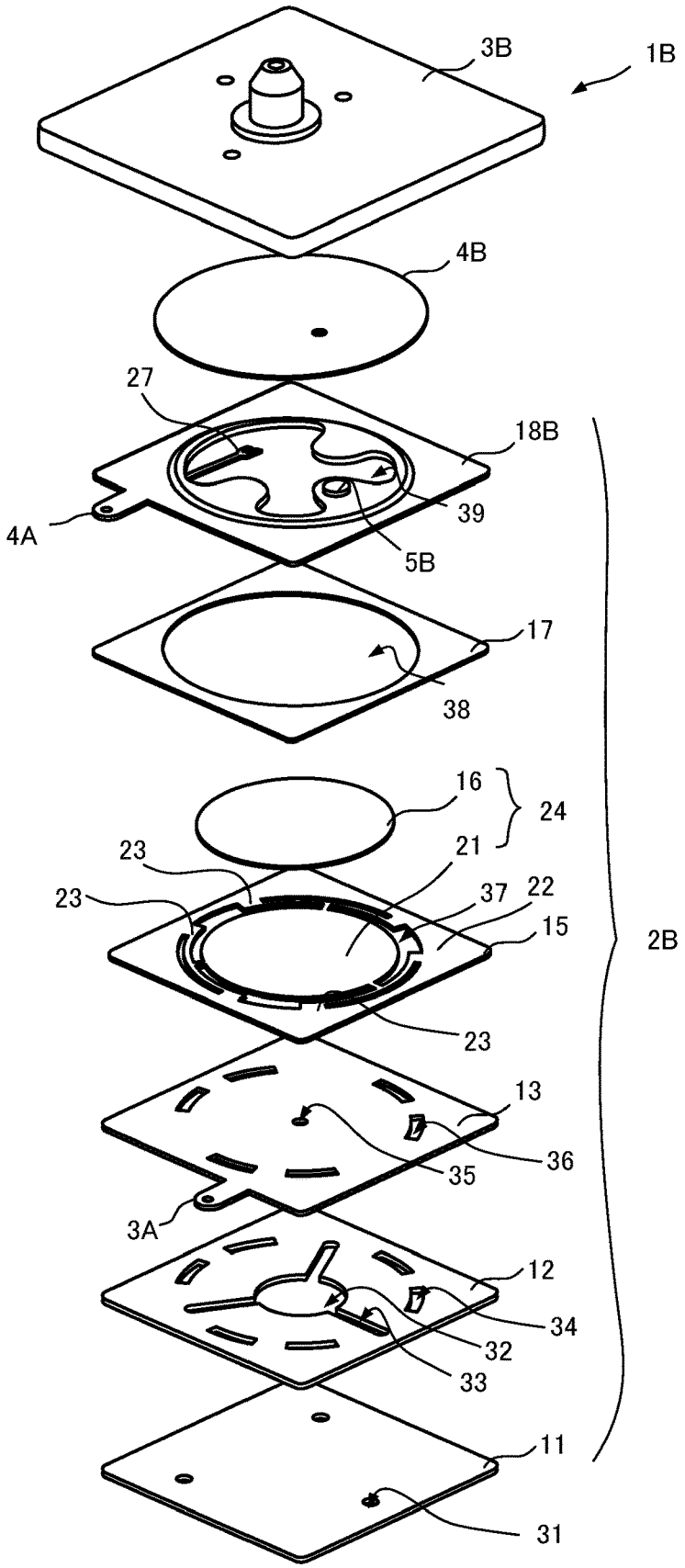
FIG. 10 is an exploded perspective view of a pump 1B according to a fourth embodiment of the present disclosure.

FIG. 10 is an exploded perspective view of a pump 1B according to the fourth embodiment.

The pump 1B is provided with a pump housing 2B, a valve housing 3B, and a diaphragm 4B. The pump housing 2B is configured such that the power feeding plate 18, the lid plate 20, and the spacer plate 19) of the pump 1A according to the second embodiment are removed and a power feeding plate 18B is provided. The power feeding plate 18B has a configuration in which a valve convex portion 5B that cylindrically projects from the top surface side of one of the wave-shaped portions 43 is added to the configuration of the second embodiment. The pump housing 2B discharges the fluid that is sucked from a lower principal surface side, to a top surface side.

The valve housing 3B is provided on a top surface side of the pump housing 2B, and prevents the fluid that discharges the pump housing 2B from flowing backward to the pump housing 2B. The diaphragm 4B has a flat film shape and flexibility, and is held between the valve housing 3B and the pump housing 2B.

Figure 11A:
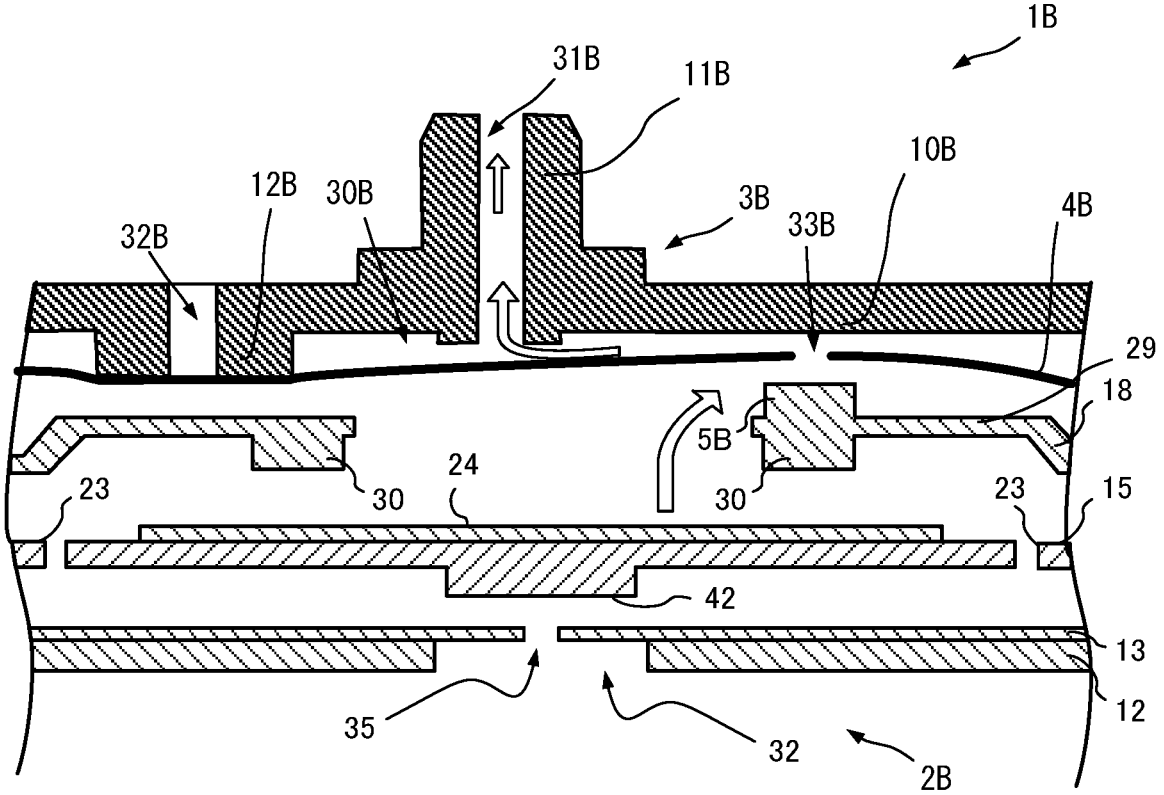
FIG. 11A and FIG. 11B are schematic cross-sectional views of a main portion of the pump 1B.
Figure 11B:
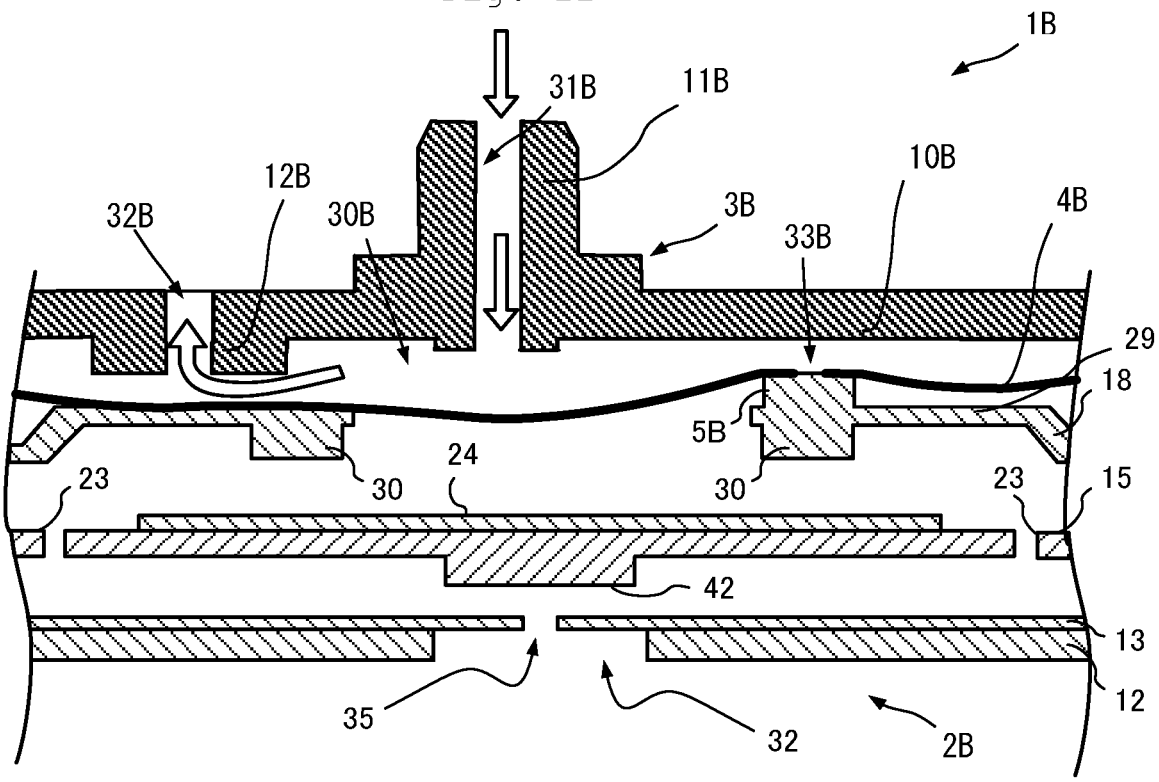

FIG. 11A and FIG. 11B are schematic cross-sectional views of a main portion of the pump 1B. FIG. 11A shows a case in which fluid flows in a forward direction, and FIG. 11B shows a case in which fluid flows in a reverse direction.

The valve housing 3B includes a top plate 10B, an external connecting portion 11B that projects upward from the top plate 10B, and a valve seat 12B that projects downward from the top plate 10B. The external connecting portion 11B includes a first flow path hole 31B that ventilates an internal space 30B of the valve housing 3B and the external space. The valve seat 12B includes a second flow path hole 32B that ventilates the internal space 30B of the valve housing 3B and the external space. The diaphragm 4B includes an opening 33B at a position facing the valve convex portion 5B provided in the power feeding plate 18B.

The diaphragm 4B includes a portion around the opening 33B that comes into contact with the valve convex portion 5B as the diaphragm 4B is pressurized from the internal space 30B of the valve housing 3B, and separates from the valve convex portion 5B as the diaphragm 4B is pressurized from the side of the pump housing 2B. In addition, the diaphragm 4B includes a portion facing the valve seat 12B that separates from the valve seat 12B as the diaphragm 4B is pressurized from the internal space 30B of the valve housing 3B, and comes into contact with the valve seat 12B as the diaphragm 4B is pressurized from the side of the pump housing 2B.

Accordingly, as shown in FIG. 11A, in a case in which fluid flows in the forward direction, the opening 33B of the diaphragm 4B is separated from the valve convex portion 5B and is opened, and the fluid flows from the side of the pump housing 2B into the internal space 30B of the valve housing 3B. Then, since the second flow path hole 32B is closed by the diaphragm 4B, the fluid is discharged to the outside through the first flow path hole 31B.

In addition, as shown in FIG. 11B, in a case in which fluid flows in the backward direction and flows from the outside into the internal space 30B of the valve housing 3B through the first flow path hole 31B, since the opening 33B of the diaphragm 4B contacts the valve convex portion 5B and is closed and the diaphragm 4B is separated and the second flow path hole 32B is open, the fluid is discharged to the outside through the second flow path hole 32B.

Thus, in the pump 1B according to the fourth embodiment, even when the discharged fluid flows backward, the fluid does not reach the side of the pump housing 2B and may be discharged to the outside through another flow path hole.

While the pump 1B according to the fourth embodiment has a configuration in which the pump housing 2B, the valve housing 3B, and the diaphragm 4B are integrally formed, the pump housing 2B, the valve housing 3B, and the diaphragm 4B may be completely separately configured. The pump housing 2B, the valve housing 3B, and the diaphragm 4B are integrally configured, so that even the pump 1B that has a valve function may be downsized. In particular, in the pump 1B according to the fourth embodiment, since the power feeding plate 18B provided with the displacement regulating portions 30 includes the valve convex portion 5B for achieving a valve function, the pump 1B that has the valve function is able to be made extremely small.

While the present disclosure may be implemented as shown in each of the above embodiments, the present disclosure may be implemented in an embodiment other than the above embodiments. For example, while each of the above embodiments uses the piezoelectric element in which expansion and contraction occurs in the in-plane direction, the present disclosure is not limited to these examples. For example, the vibrating plate may be bent and vibrated electromagnetically.

In addition, while each of the above embodiments provides the displacement regulating portions on the power feeding plate so as to project from the bottom surface side, the present disclosure is not limited to these examples. For example, the displacement regulating portions may project from a lid plate or the like. Moreover, the displacement regulating portions may be provided on the lower side (the second pump chamber) of the vibrating portion 24, and may be provided on both the lower side (the second pump chamber 60B) and the upper side (the first pump chamber 60A) of the vibrating portion 24.

Furthermore, while each of the above embodiments provides three cylindrical displacement regulating portions, the number of displacement regulating portions, the shape of the displacement regulating portions, and the arrangement of the displacement regulating portions are not limited to the above mentioned examples. For example, the displacement regulating portions may be made into the shape of a square pillar or the shape of a circular ring. In addition, the displacement regulating portions may be made into the shape of a circular ring that has an outer shape slightly smaller than the outer shape of the vibrating portion 24. Moreover, the displacement regulating portions may be provided at one location, two locations, or four or more locations.

Furthermore, while each of the above embodiments determines the frequency of an alternating current drive signal so that the vibrating plate may be vibrated in the third-order resonance mode, the present disclosure is not limited to these examples. For example, the frequency of an alternating current drive signal may be determined so that the vibrating plate may be vibrated in a first-order resonance mode or in a fifth-order resonance mode.

In addition, while each of the above embodiments uses gas as fluid, the present disclosure is not limited to these examples. For example, the fluid may be liquid, vapor-liquid mixed fluid, gas-solid mixed fluid, or solid-liquid mixed fluid. Moreover, while each of the above embodiments sucks fluid to the pump chamber through the flow path hole provided in the facing plate, the present disclosure is not limited to these examples. For example, the fluid may be discharged from the pump chamber through the flow path hole provided in the facing plate. Whether fluid is to be sucked or discharged through the flow path hole provided in the facing plate may be based on the direction of the traveling waves or the difference in vibration between the convex portion and the movable portion.

Lastly, the foregoing embodiments are exemplary and should not be construed to limit the present disclosure. The scope of the present disclosure is limited by the foregoing embodiments but by the following claims. Further, the scope of the present disclosure is intended to include all modifications within the scopes of the claims and their equivalents.

REFERENCE SIGNS LIST

1, 1A, 1B Pump
2, 2A, 2B Pump housing
3 Vibrating plate
4 Driving portion
5 Displacement regulating portion
6 Pump chamber
7 Flow path
8 Opening
9 Vibrating portion
3A, 4A External connection terminal
5A, 6A Principal surface
7A Pump chamber
11 Cover plate
12 Flow path plate
13 Facing plate
15 Vibrating plate
16 Piezoelectric element
17 Insulating plate
18, 18A, 18B Power feeding plate
19 Spacer plate
20 Lid plate
21 Circular plate portion
22 Frame portion
23 Link portion
24 Vibrating portion
27 Internal connection terminal
28 Frame portion
29, 29A Supporting portion
30, 30A Displacement regulating portion
31 Flow path hole
32 Opening
33 Flow path
35 Flow path hole
42 Convex portion
43, 43A Wave-shaped portion
44 Movable portion
3B Valve housing
4B Diaphragm
5B Valve convex portion
10B Top plate
11B External connecting portion
12B Valve seat
33B Opening

What is claimed is:

1. A pump comprising:
a pump housing internally including a pump chamber;
a vibrating portion mounted to the pump housing, the vibrating portion having a surface that faces the pump chamber;
one or more link portions that mount the vibrating portion to the pump housing such that the vibrating portion is supported by the one or more link portions;
a driving portion arranged on the vibrating portion in the pump housing and configured to drive the vibrating portion so as to bend and vibrate the vibrating portion in a predetermined direction; and
a displacement regulating portion positioned to prevent displacement of the vibrating portion that results in plastic deformation of the vibrating portion,
wherein the displacement regulating portion is positioned above an outer periphery of the vibrating portion such that the displacement regulating portion overlaps the outer periphery in a plan view of the pump, a viewing direction of the plan view being normal to the surface of the vibrating portion.

2. The pump according to claim 1, wherein the displacement regulating portion projects from an inner wall of the pump housing into the pump chamber.

3. The pump according to claim 1, wherein the displacement regulating portion is not positioned in a space that will interfere with the vibrating portion when the driving portion drives the vibration portion and causes the vibrating portion to bend and vibrate.

4. The pump according to claim 1, further comprising a flat plate-shaped member defining the displacement regulating portion, wherein the flat plate-shaped member comprises:
a supporting portion projecting from a side of the pump housing into the pump chamber; and
a projecting portion projecting from the supporting portion toward the vibrating portion.

5. The pump according to claim 4, wherein the flat plate-shaped member comprises an internal connection terminal projecting from the pump housing into the pump chamber, the internal connection terminal having a tip connected to the vibrating portion.

6. The pump according to claim 4, wherein the driving portion is configured to drive the vibrating portion such that the vibrating portion bends and vibrates in a high-order resonance mode that produces a node of vibration.

7. The pump according to claim 6, wherein the displacement regulating portion faces the node of vibration.

8. The pump according to claim 4, wherein the displacement regulating portion faces an outer peripheral portion of the vibrating portion.

9. The pump according to claim 2, further comprising another displacement regulating portion that projects from the inner wall and faces the vibrating portion.

10. The pump according to claim 1, the pump including a plurality of the displacement regulating portions that are aligned at intervals from each other.

11. The pump according to claim 10, wherein the plurality of displacement regulating portions includes three displacement regulating portions.

12. The pump according to claim 4, wherein the pump is configured as a laminate of a plurality of flat-shaped members.

13. The pump according to claim 4, wherein the supporting portion defines an opening.

14. The pump according to claim 13, wherein the supporting portion comprises a plurality of wave-shaped portions that project toward the opening.

15. The pump according to claim 14, the pump including a plurality of the displacement regulating portions, wherein each of the plurality of displacement regulating portions is provided on a corresponding one of the plurality of wave-shaped portions.

16. The pump according to claim 15, wherein each of the plurality of displacement regulating portions is provided on a bottom surface of its corresponding wave-shaped portion.

17. The pump according to claim 15, wherein the plurality of wave-shaped portions comprises three wave-shaped portions.

18. The pump according to claim 2, wherein the displacement regulating portion projects from the inner wall along an entire circumference of the inner wall.

19. The pump according to claim 6, wherein the displacement regulating portion projects from the supporting portion toward the node of vibration.

20. The pump according to claim 1, wherein:

the displacement regulating portion is not positioned in a first space that will interfere with the vibrating portion when the driving portion drives the vibrating portion and causes the vibrating portion to bend and vibrate, and the displacement regulating portion is positioned in a second space in which the vibrating portion is able to deform elastically, the second space being above the first space.

21. The pump according to claim 1, wherein:

the displacement regulating portion has a surface that faces the vibrating portion and is positioned to prevent displacement of the vibrating portion that results in plastic deformation of the vibrating portion, and the surface of the displacement regulating portion is positioned above the outer periphery of the vibrating portion such that the surface of the displacement regulating portion overlaps the outer periphery in the plan view of the pump.

22. The pump according to claim 1, wherein the pump includes a plurality of the link portions and a plurality of openings defined by the plurality of the link portions.

23. The pump according to claim 22, wherein the plurality of openings surround the vibrating portion such that a common plane extends through the plurality of openings and vibrating portion.

24. The pump according to claim 1, wherein the one or more link portions are arranged within the pump chamber.

* * * * *